United States Patent [19]

Isono

[11] 4,099,346

[45] Jul. 11, 1978

[54] ADJUSTABLY LOUVERED ROOF PLATE ASSEMBLY

[75] Inventor: Nobujiro Isono, Sando, Japan

[73] Assignee: Shin Nippon Kinzoku Co., Ltd., Tokyo, Japan

[21] Appl. No.: 748,042

[22] Filed: Dec. 6, 1976

[30] Foreign Application Priority Data

Jul. 27, 1976 [JP] Japan ..... 51-99947[U]

[51] Int. Cl.[2] ..... E05F 17/00; E06B 7/096

[52] U.S. Cl. ..... 49/82; 49/86; 49/90; 74/142; 160/236

[58] Field of Search ..... 49/82, 83, 84, 85, 90, 49/74, 86; 98/121 R, 121 A, 110, 40 U; 74/140, 142, 141, 577 S; 160/236

[56] References Cited

U.S. PATENT DOCUMENTS

| | | | |
|---|---|---|---|
| 1,888,522 | 11/1932 | Ward | 49/86 |
| 1,930,254 | 10/1933 | Simon | 49/86 X |
| 2,456,311 | 2/1944 | Paget | 98/121 A X |
| 3,188,074 | 6/1965 | Reutz et al. | 49/90 X |
| 3,242,746 | 3/1966 | Seiden | 74/142 |
| 3,412,506 | 11/1968 | Shiota | 49/82 |
| 3,783,768 | 1/1974 | Caming et al. | 98/121 A X |
| 3,881,361 | 5/1975 | Newell | 74/142 X |

FOREIGN PATENT DOCUMENTS

| | | | |
|---|---|---|---|
| 629,757 | 12/1961 | Italy | 160/236 |

*Primary Examiner*—Philip C. Kannan
*Attorney, Agent, or Firm*—Cushman, Darby & Cushman

[57] ABSTRACT

This invention provides a roof in which plurality of louver-type roof plates are designed to be opened and closed by means of a reciprocating connecting rod pivoted to cranks secured to said roof plates. A ratchet gear mechanism is mounted to connect with the said connecting rod through a crank shaft so that the said ratchet gear may rotate tooth by tooth to adjust the roof plates stepwise between a fully open and a fully closed condition. An accommodation for draining rainwater from the roof is disclosed, as are several designs of roof plates.

6 Claims, 14 Drawing Figures

ADJUSTABLY LOUVERED ROOF PLATE ASSEMBLY

BACKGROUND OF THE INVENTION

Conventionally, roof plates of louvered roofs have been opened and closed by means of pulling cords connected with both edges of the roof plates.

Therefore, it has been difficult to open and close the roof plates to the desired angle.

SUMMARY OF THE INVENTION

One purpose of this invention is to provide users with a roof, the assembly of plates of which may be gradually opened and closed, for instance utilizing a ratchet gear rotated tooth by tooth by a cranked pawl.

Another purpose of this invention is to prevent rain drops from dripping from the eave side of the assembly of roof plates. To attain this purpose the eave side frame of the assembly of roof plates is formed into a frame fabricated from a C-type and an L-type sub-frame with the base of the latter-type sub-frame constructed to be a water channel covering the lower part of the eave side of the assembly of roof plates.

Another purpose of this invention is to protect such an opening and closing device as a ratchet gear mechanism from bad weather such as wind and rain. To attain the purpose, the said opening and closing device is contained within the C-type sub-frame an opening of which is covered by the L-type sub-frame.

Another purpose of this invention is to facilitate transportation of the said roof plates as well as reinforce the mechanical strength of the core of each so it will not be damaged due to repeated opening and closing. In other words, there is provided a set of roof plates each comprising an assembled band-type plate and a core which may be disassembled into a pair of band-type plate elements and core so as to facilitate transportation of these items in their disassembled condition.

The joint members for assembling a pair of the band-type plate elements and a core may play the role of a rib to reinforce the mechanical strength of the core, protecting itself from damage due to repeated openings and closings.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION OF THE PRESENTLY PREFERRED EMBODIMENTS

Figure 1:
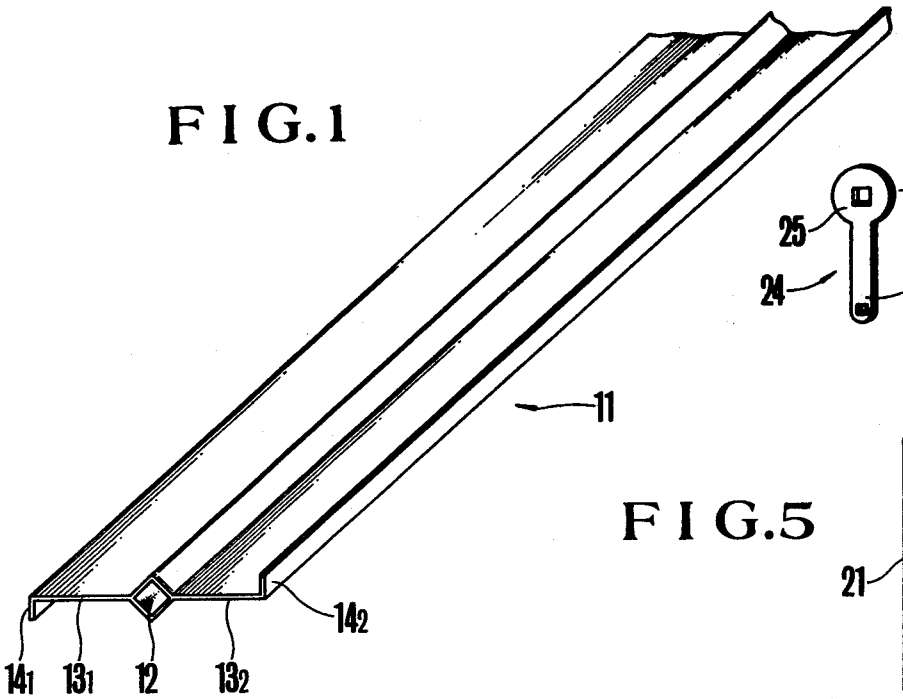
FIG. 1 is a isometric view of one roof plate.

As shown in FIG. 1, the roof plate 11 includes a core 12, a pair of band-type plates $\mathbf{13_1}$, $\mathbf{13_2}$ with a tubular core 12 of square transverse cross-sectional shape. The pair of band-type plates $\mathbf{13_1}$, $\mathbf{13_2}$ project in a plane from a pair of diagonally opposite corners of the core 12.

The band-type plates are each provided with a generally right angle flange portion $\mathbf{14_1}$, $\mathbf{14_2}$ respectively projecting from their outer edges in opposite directions.

Figure 4:
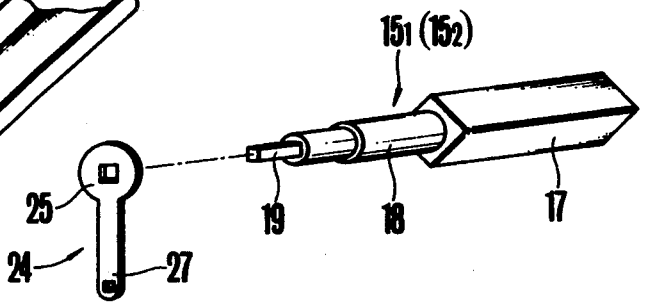
FIG. 4 is an exploded isometric view of the side shaft of one roof plate and a crank therefore.
Figure 5:
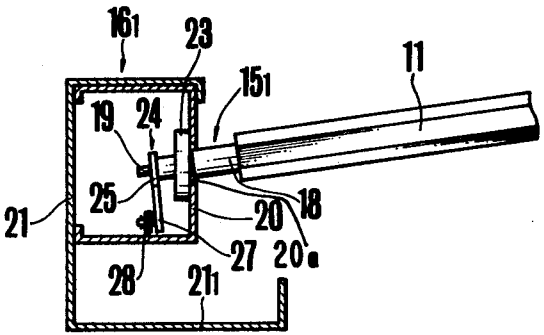
FIG. 5 is a transverse cross-sectional view of one side frame.
Figure 2:
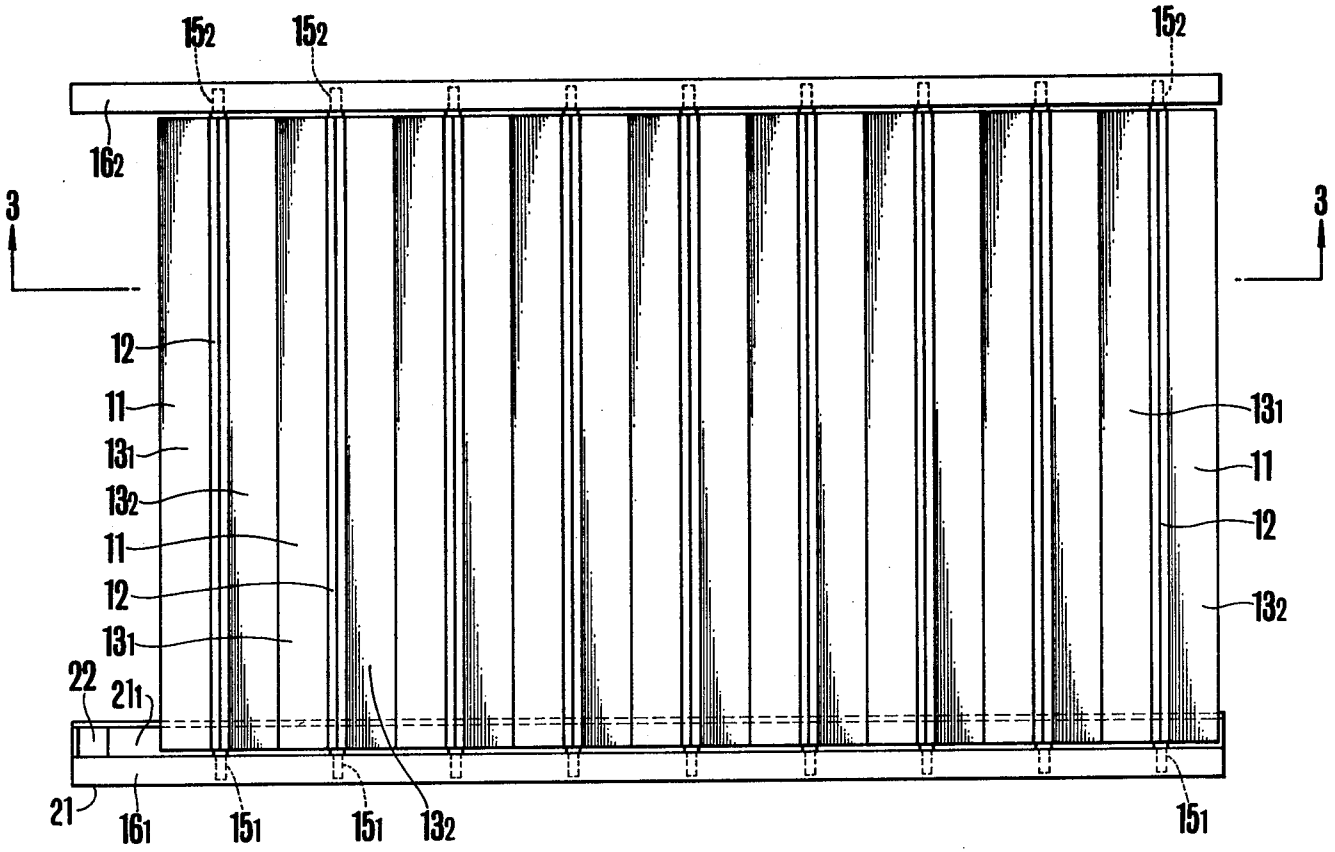
FIG. 2 is a plan of a roof assembled using a plurality of such roof plates.

As shown in FIGS. 2 and 4, a shaft $\mathbf{15_1}$, $\mathbf{15_2}$ with a portion 17 of square transverse cross-sectional shape is fitted into each end of the core 12 and has a smaller width portion 18 of stepped circular transverse cross-sectional shape protruding outwardly therefrom that ends in a smaller width portion 19 of square transverse cross-sectional shape.

The roof further includes frames $\mathbf{16_1}$ and $\mathbf{16_2}$. In the instance depicted, the frames $\mathbf{16_1}$ and $\mathbf{16_2}$ are designed to be mounted in a pitched roof, to extend from side-to-side along the roof, with the frame $\mathbf{16_2}$ nearer the ridge and the frame $\mathbf{16_1}$ nearer the eave.

Figure 3:
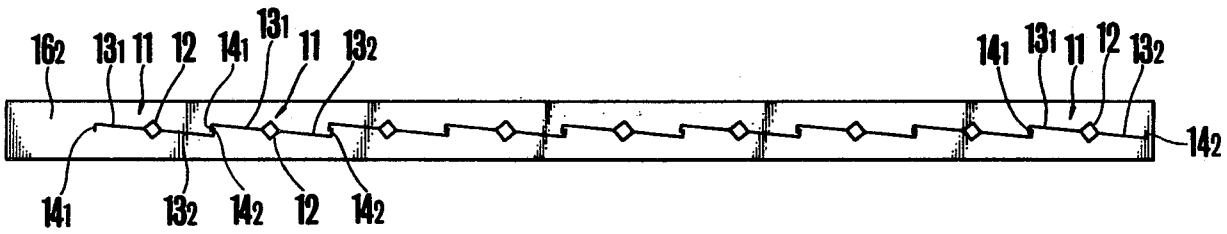
FIG. 3 is a cross-sectional view along line 3—3 of FIG. 2.

Both frames $\mathbf{16_1}$, $\mathbf{16_2}$ include a C-shaped sub-frame element 20 with a series of openings **20*a* running along its central flange. The openings are so close together, that when the shaft portions 18 are inserted therein, the flanges $\mathbf{14_1}$, $\mathbf{14_2}$ of adjacent roof plates interdigitate when the plates are rotated to a closed condition (FIG. 3**). Note that when in this condition, the upper flanges $\mathbf{14_1}$ are directed downwards, the lower flanges $\mathbf{14_2}$ are directed upwards and the plates $\mathbf{13_1}$ and $\mathbf{13_2}$ of each roof plate are slightly pitched relative to horizontal, to provide a plurality of channels for rain run-off towards the frame $\mathbf{16_1}$.

The frame $\mathbf{16_1}$ further includes an L-shaped sub-frame 21 with a vertical flange that closes the open-side of the C-shaped frame and a horizontal flange which extends under the C-shaped frame, then upwards at the end to provide a rain gutter $\mathbf{21_1}$.

In FIG. 2, the sub-frame 21 is shown provided with an opening 22 in its floor to provide a downspout outlet for its rain gutter $\mathbf{21_1}$.

Within each frame $\mathbf{16_1}$, $\mathbf{16_2}$ bearings 23 are secured on the shaft portions 18 to retain and journal the roof plates with respect to the frames.

A crank 24 is secured on each shaft square portion 19. Each crank 24 includes a disk portion 25 with a square opening 26 which receives and keys with the respective shaft portion 19, and a tongue 27 which projects laterally from the respective disk portion 25.

Within each frame $\mathbf{16_1}$, $\mathbf{16_2}$, all the tongues 27 are pivotally secured to a respective connecting rod 28.

A ratchet gear mechanism 29 is mounted inside each C-type frame 20.

Figure 8:
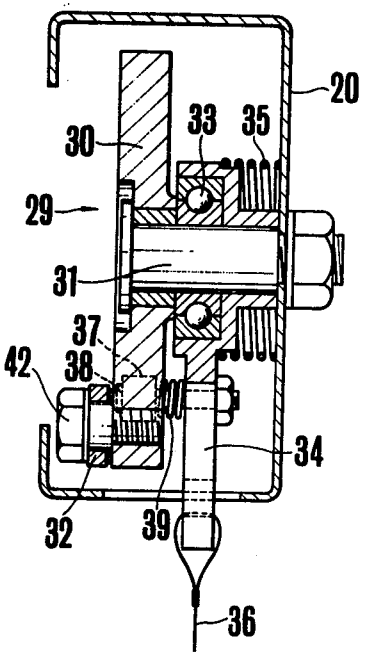
FIG. 8 is a transverse cross-sectional view of the ratchet gear mechanism.
Figure 7:
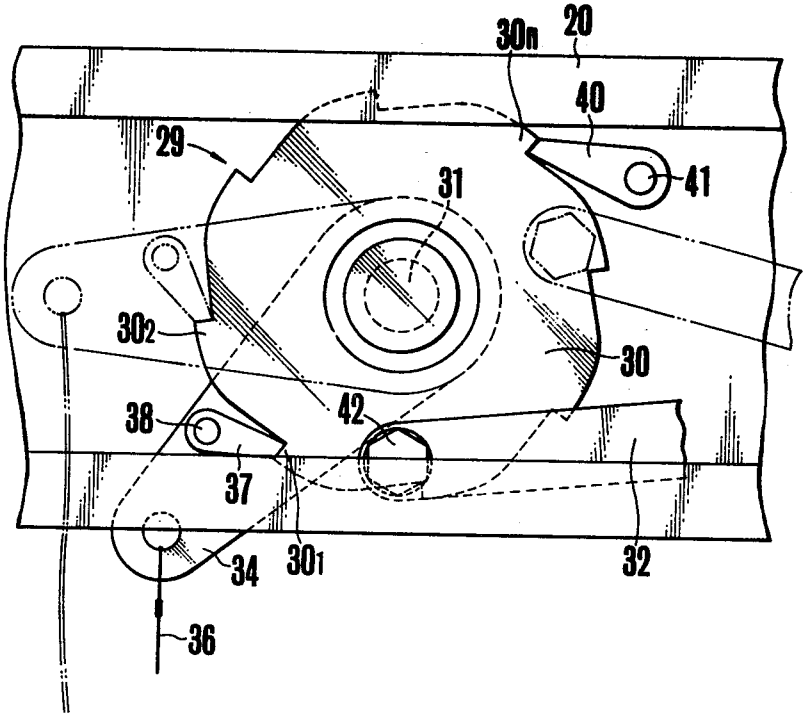
FIG. 7 is a larger scale elevation of the ratchet gear mechanism.

As shown in FIGS. 7 and 8 each mechanism 29 includes a ratchet gear 30 rotatably mounted on a shaft 31.

Figure 6:
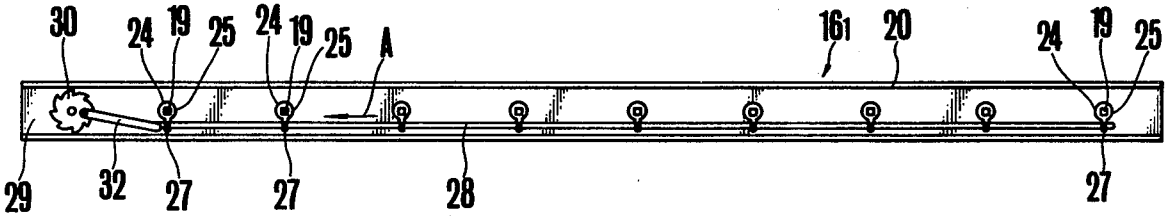
FIG. 6 is a side elevational view of one C-type frame.

As shown in FIG. 6, the ratchet gear 30 is connected to the connecting rod 28 by means of a crank shaft 32.

A handling plate 34 is pivotally mounted on the shaft 31 through a bearing 33.

A handling cord 36 is tied to the said handling plate and hangs down through the base of the C-type frame 20 and the handling plate 34 to be rotated downward by means of pulling the handing cord 36.

A driving pawl 37 pivotally mounted on the handling plate 34 by means of a shaft 38 is depressed on the circumferential surface of the said ratchet gear 30 by means of spring 39 tension. The ratchet gear 30 is rotated counterclockwise (downward) in case the driving pawl 37 proceeds downward together with the handling plate 34 with this pawl 37 engaged with the step portion of a tooth $30_1$ of the ratchet gear 30 and the pawl 37 rises up together with the handling plate 34 after completion of the downward movement along the slope of the tooth $30_2$ next to the ratchet gear 30 to be engaged with the rectangular portion of the next tooth $30_2$ once again.

A check pawl 40 is mounted adjacent the ratchet gear diametrically opposite the driving pawl 37. The said check pawl 40 is universally held on the C-type frame by means of a shaft 41 and depressed on the circumferential surface of the said ratchet gear 30 by means of spring (not shown) providing tension similar to the case of the said driving pawl 37.

However, the function of the said check pawl 40 is in reverse to that of the driving pawl 37, i.e. in case the ratchet gear 30 is completely rotated by the driving nail 37, the check nail 40 is engaged with a rectangular portion of one tooth $30_n$ so as to prevent the ratchet gear 30 from reverse rotation (clockwise rotation).

As shown in FIG. 8, the ratchet gear 30 and a crank shaft 32 are fixed together by means of a bolt 42.

The roof is operated as follows. With the said handling cord 36 of the ratchet gear mechanism 29 pulled downward, the handling plate 34 is rotated downward against the tension of the spring 35 together with the driving pawl 37.

The edge of this driving pawl 37 being engaged with a step portion of one tooth, the ratchet gear 30 is rotated counterclockwise tooth by tooth by means of the downward rotation of the driving pawl 37.

On the contrary, whenever pulling of the handling cord is stopped, the handling plate 34 is reset to the original position by the tension of the spring 35.

At that time, the driving pawl 37 resets to the original position together with the handling plate 34 rising up along the slope of the tooth $30_2$ next along the ratchet gear 30 to be engaged with a step portion once again.

With the handling cord 36 pulled down again, the ratchet gear 30 may be rotated counterclockwise by one tooth similar to the said case and further with the handling cord 36 pulled down repeatedly, the ratchet gear 30 may be gradually rotated counterclockwise tooth by tooth.

The check pawl 40 is mounted on the opposite side of the ratchet gear 30 to be engaged with a step portion of one tooth to prevent the ratchet gear 30 from reverse rotation (clockwise rotation). The said ratchet gear 30 is connected to the connecting rod 28 through the crank shaft 32.

Therefore, with the ratchet gear 30 rotated tooth by tooth the connecting rod 28 is linearly reciprocated by means of the crank shaft 32.

With the connecting rod 28 moved in the arrow mark A direction shown in FIG. 6, the rotor 24 the tongue 27 of which is pivoted to the connecting rod 28 (corresponding to the number of the roof plates) is rotated clockwise together with the shaft $15_1$ at one edge side of the roof plates 11 converting the roof plates from horizontal to vertical status so as to open the roof 11.

In case the roof plates 11 are rotated as mentioned above, a force to reverse the ratchet gear 30 is exerted through the shaft $15_1$, the rotor 24, the connecting rod 28 and the crank shaft 32.

However, the ratchet gear 30 is prevented from reverse rotation by means of the check pawl 40.

With the ratchet gear 30 rotated by means of handling the handling cord 36 tooth by tooth, the angle of the roof plates 11 may be changed tooth by tooth through the crank shaft 32, the connecting rod 28, the rotor 24 and the shaft $15_1$.

Therefore, the roof plates 11 may be gradually opened and the rotation angle of the ratchet gear 30 may be adjusted by means of the handling cord 36.

With the connecting rod 28 moved in the reverse direction to the arrow mark A, the rotor 24 and the shaft $15_1$ are rotated counterclockwise to rotate the roof plates 11 counterclockwise changing them from vertical to horizontal status i.e. closing the roof plates 11.

It is a matter of course that in case of closing the roof plates, they may be gradually closed sustaining any desired angle.

Figure 9:
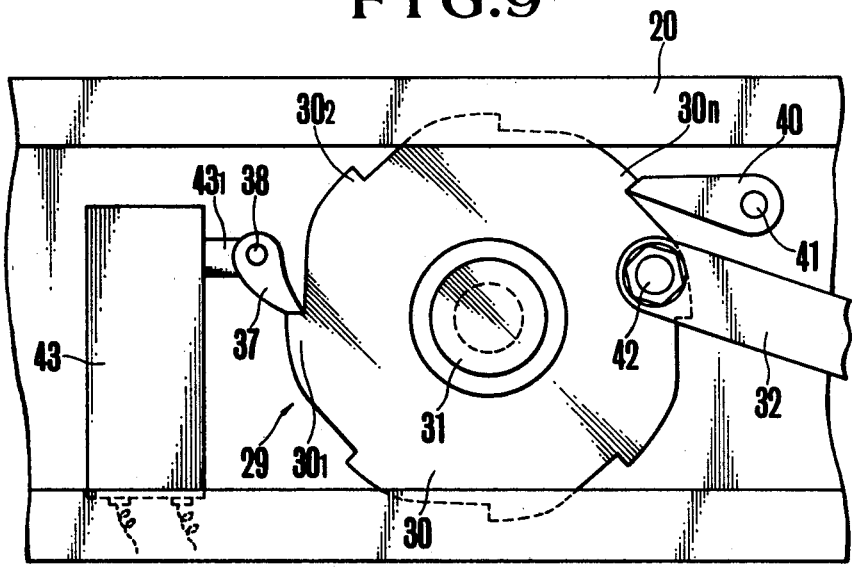
FIG. 9 is an elevation similar to FIG. 7, of a modified form of the ratchet gear mechanism.

Another embodiment of this invention is shown in FIG. 9. In this embodiment, a plunger 43 e.g. a solenoid is mounted to hold the driving pawl 37 on its movable portion $43_1$ so that the ratchet gear 30 may be rotated by actuating the driving pawl 37 by means of electrically operating the said plunger 43 by handling a switch so as to open and close the roof plates without any manual operation.

Figure 10:
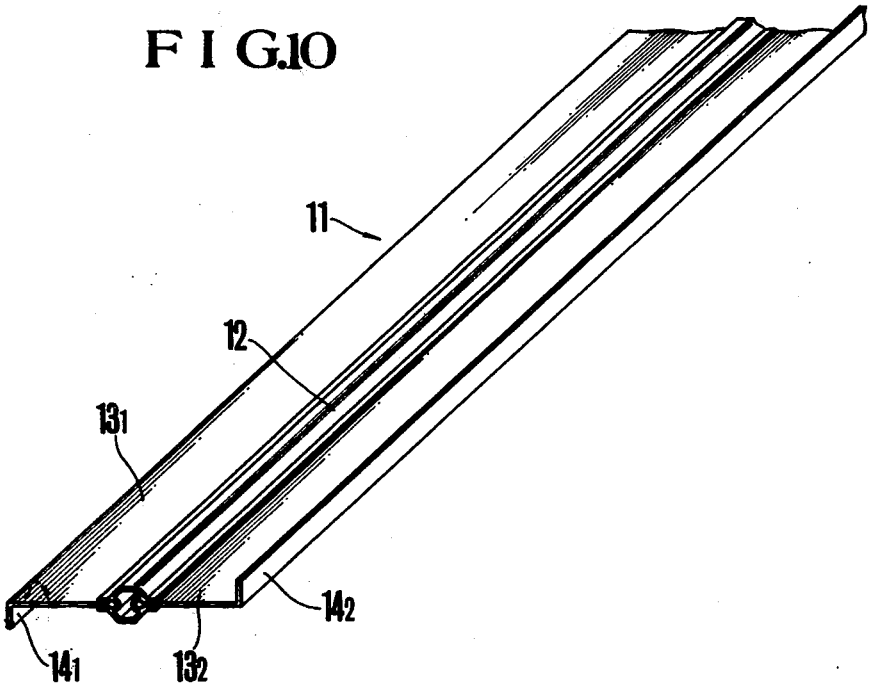
FIG. 10 is an isometric view of a modified roof plate.

FIG. 10 indicates another embodiment of the roof plates 11 comprising a core 12 and a pair of band type plates $13_1$, $13_2$.

Figure 11:
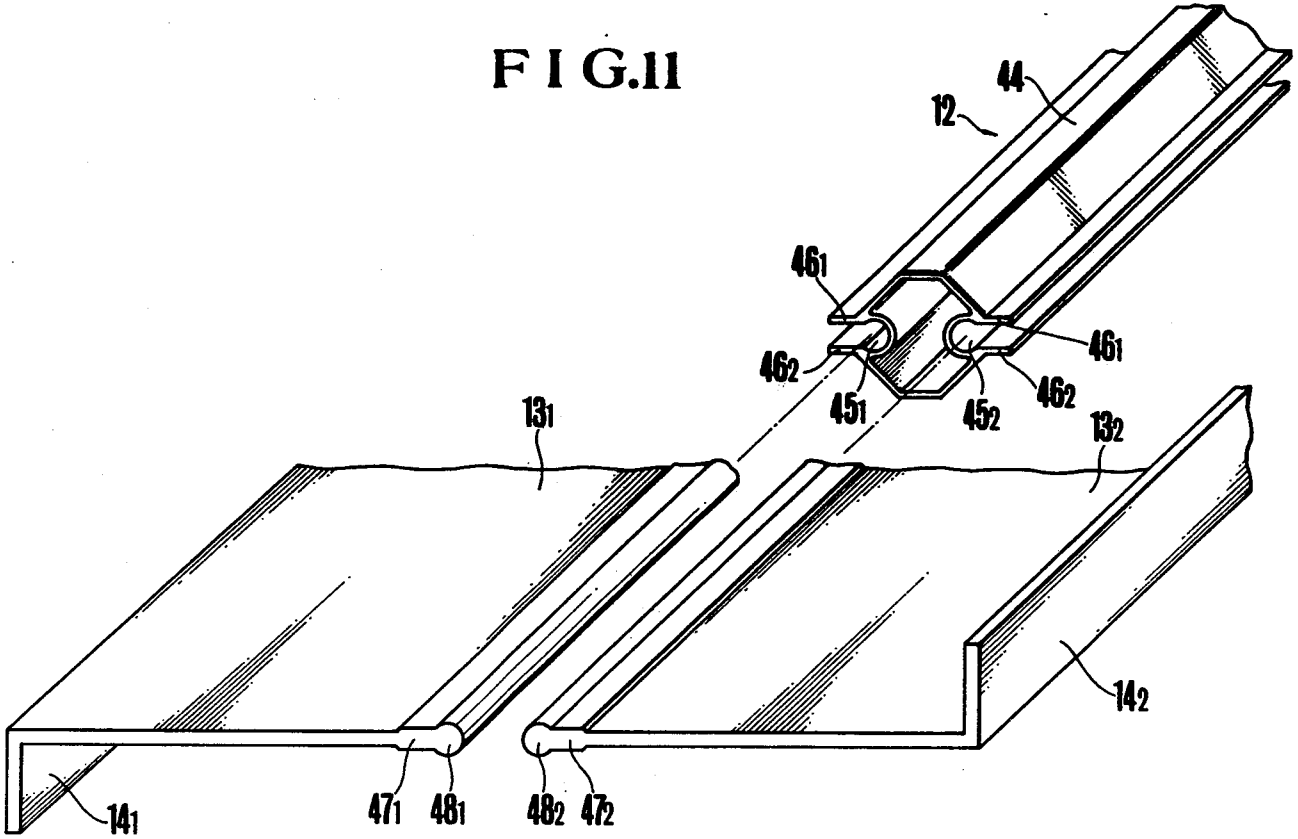
FIG. 11 is a fragmentary exploded isometric view of the roof plate of FIG. 10.

As shown in FIG. 11 the core 12 comprises a polygonal tube 44, a pair of engagement recesses $45_1$, $45_2$ two pairs of jaws $46_1$, $46_2$ incorporated in a shape with an irregular hexagonal section.

Each of the engagement recesses $45_1$, $45_2$ is formed as a dovetail groove with round section at diagonally opposed corners of the said polygonal tube 44 projecting to the hollow portion of the tube 44 in the longitudinal direction.

Two pairs of jaws $46_1$, $46_2$ are formed respectively at each opening of the said engagement recesses $45_1$, $45_2$ projecting outward in the longitudinal direction.

On the other hand, internal long sides of a pair of band-type plates $13_1$, $13_2$ are formed to have thicker wall portions $47_1$, $47_2$ corresponding to the thickness of a pair of jaws $46_1$, $46_2$ and a pair of enlarged shafts $48_1$, $48_2$ with round sections are formed corresponding to the shape of the said engagement recesses $45_1$, $45_2$.

The pair of band-type plates $13_1$, $13_2$ is provided with flanges $14_1$, $14_2$ in opposite directions at the long sides of the outer edges thereof.

The core 12 and the pair of band-type plates $13_1$, $13_2$ formed as mentioned above are integrated into a roof plate with the pair of band-type plates $13_1$, $13_2$ longitudinally slidingly assembled with the core 12 so as to project from both sides of the core 12.

At that time, the pair of band-type plates $13_1$, $13_2$ are inserted into the core 12 from one side to be held and projected from both sides of the core 12 with the enlarged shaft $48_1$, $48_2$ and the thicker wall portions $47_1$, $47_2$ respectively inserted into the corresponding engagement recesses $45_1$, $45_2$ and the pair of jaws $46_1$, $46_2$.

Therefore, the roof plates 11 comprise the pair of band-type plates $13_1$, $13_2$ and the core 12, i.e. those components may be disassembled to facilitate their transportation.

In the core 12 of the roof plates 11, a pair of engagement recesses $45_1$, $45_2$ project inward as well as two pairs of jaws $46_1$, $46_2$ projecting outward to play the role of a rib so as to reinforce the mechanical strength of the core 12 for preventing it from damage due to repeated opening and closing.

Figure 12:
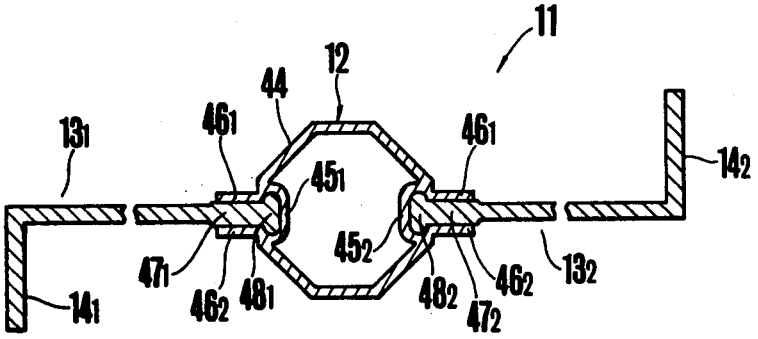
FIG. 12 is a transverse sectional view of another embodiment of the roof plate.

FIG. 12 indicates another different embodiment of the roof plates 11 in which the polygonal tube 44 of the core 12 is formed into a shape with an octagonal section and a pair of engagement recesses $45_1$, $45_2$ with oval sections are formed into a dovetail groove at a pair of diagonally opposite sides and the enlarged shaft $48_1$, $48_2$ of the pair of band-type plates $13_2$, $13_2$ with oval sections may be formed corresponding to the pair of engagement recesses.

Figure 13:
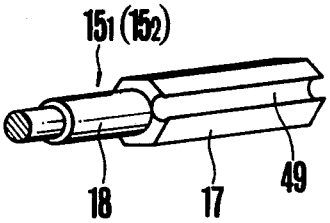
FIG. 13 is an isometric view of the side shaft used for the roof plate of FIG. 10.

In case the roof plates 11 are made as shown in FIGS. 10 and 11, one edge side polygonal shaft 17 of the shafts $15_1$, $15_2$ to fix the roof plates 11 to the frame $16_1$, $16_2$ may be made as shown in FIG. 13, i.e. the polygonal shaft 17 of the shaft $15_1$, $15_2$ may be formed into a shape with irregular hexagonal section corresponding to the polygonal tube 44 of the core 12 together with a groove 49 with round section at a pair of corner facing each other.

Figure 14:
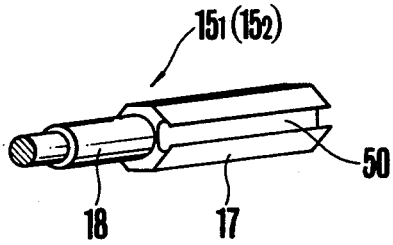
FIG. 14 is an isometric view of the side shaft used for the roof plate of FIG. 12.

In case the roof plates 11 are made as shown in FIG. 12, one edge side polygonal shaft 17 of the shaft $15_1$, $15_2$ may be made as shown in FIG. 14, i.e. the said polygonal shaft 17 of the shaft $15_1$, $15_2$ may be made into a shape with octagonal section together with a groove 50 with oval sections at a pair of corners facing each other.

What is claimed is:

1. A louver-type roof assembly, comprising:

a plurality of elongated roof plates arranged side-by-side and each having shaft means extending from each end thereof;

a pair of frames, each with a series of openings for receiving the respective shaft means of said roof plates, means retaining the shafts in the respective openings for rotation in a sense to open and close the roof;

a crank secured on each said shaft at a respective one end of each roof plate;

connecting rod means extending along one of said frames;

each crank being pivotally connected to the connecting rod means;

a ratchet gear;

means journalling the ratchet gear for rotation on said one frame;

a drive pawl;

means mounting the drive pawl adjacent the ratchet gear for engagement therewith for actuation to rotate the ratchet gear in a stepwise fashion;

a check pawl;

means mounting the check pawl adjacent the ratchet gear for engagement therewith to prevent undesired counter rotation of the ratchet gear;

a crank shaft pivotally interconnecting the ratchet gear and the connecting rod means so that each time the drive pawl is actuated to rotate the ratchet gear one step further, the crank shaft moves the connecting rod means a corresponding step longitudinally, thus turning said cranks one step further and correspondingly rotating the roof plates one step further;

one of said frames including upwardly open channel means arranged to catch rainwater draining along the roof plates, as a gutter, and opening means therein to provide a downspout therefor;

said one frame including a C-shaped sub-frame having an open side, an L-shaped sub-frame with a vertical flange and a horizontal flange; the vertical flange closing the open side of the C-shaped sub-frame and extending thereunder and the horizontal flange forming said gutter.

2. The roof assembly of claim 1 wherein:

the drive pawl is pivotally mounted on a handling plate that is pivotally mounted on the frame and a spring is provided to resiliently urge the drive pawl against the ratchet gear.

3. The roof assembly of claim 1 further including:

an electrically operated reciprocating plunger mounted on said one frame; and said drive pawl being mounted on said plunger so that the roof plates may be rotated by electrically operating the plunger.

4. The roof assembly of claim 1, wherein; said one frame encloses said cranks, connecting rod means, ratchet gear, drive pawl, check pawl and crank shaft.

5. The roof assembly of claim 1, wherein:

each roof plate comprises a tubular core having diametrically oppositely opening grooves which are each provided with an internal enlargement and a constricted mouth; and a pair of band-type plates each having an inner edge and an outer edge; each inner edge having an enlarged bead running therealong and each outer edge having a turned flange, the respective beads being sized to longitudinally slide in the respective internal enlargements of the respective grooves of said tubular core.

6. The roof assembly of claim 5, wherein:

the tubular core is of non-circular transverse cross-sectional internal shape; and the shafts each include a portion shaped to be complementarily received in a respective end of the respective tubular cores for keying the respective shafts to the respective roof plates.

* * * * *

UNITED STATES PATENT OFFICE

CERTIFICATE OF CORRECTION

Patent No. 4,099,346 Dated July 11, 1978

Inventor(s) Nobujiro Isono

It is certified that error appears in the above-identified patent and that said Letters Patent are hereby corrected as shown below:

Please change "[75] Inventor: Nobujiro Isono, Sando, Japan" to

-- [75] Inventor: Nobujiro Isono, Sano, Japan --

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*